US010894195B2

(12) United States Patent
Pepe

(10) Patent No.: US 10,894,195 B2
(45) Date of Patent: Jan. 19, 2021

(54) BALL TOSSING AND TRAINING DEVICE AND SYSTEM

(71) Applicant: Francis P. Pepe, Oceanside, NY (US)

(72) Inventor: Francis P. Pepe, Oceanside, NY (US)

(73) Assignee: 3 Sticks Lax, LLC, Oceanside, NY (US)

( * ) Notice: Subject to any disclaimer, the term of this patent is extended or adjusted under 35 U.S.C. 154(b) by 272 days.

(21) Appl. No.: 15/459,586

(22) Filed: Mar. 15, 2017

(65) Prior Publication Data

US 2017/0266530 A1 Sep. 21, 2017

Related U.S. Application Data

(60) Provisional application No. 62/308,954, filed on Mar. 16, 2016.

(51) Int. Cl.
*A63B 69/40* (2006.01)
*A63B 63/00* (2006.01)
(Continued)

(52) U.S. Cl.
CPC ..... *A63B 69/40* (2013.01); *A63B 43/004* (2013.01); *A63B 63/004* (2013.01); *A63B 69/0053* (2013.01); *A63B 71/0622* (2013.01); *A63B 2063/001* (2013.01); *A63B 2069/402* (2013.01); *A63B 2071/025* (2013.01); *A63B 2071/063* (2013.01); *A63B 2071/0625* (2013.01); *A63B 2102/14* (2015.10); *A63B 2220/10* (2013.01); *A63B 2220/17* (2013.01); *A63B 2220/30* (2013.01); *A63B 2220/803* (2013.01);
(Continued)

(58) Field of Classification Search
CPC ..... A63B 69/40; A63B 69/406–409; A63B 2069/401–405
USPC ..... 473/446
See application file for complete search history.

(56) References Cited

U.S. PATENT DOCUMENTS 4,915,384 A * 4/1990 Bear ..... A63B 24/0021 273/454
5,294,109 A 3/1994 Meade
(Continued)

OTHER PUBLICATIONS

Merriam Webster Dictionary Online, https://www.merriam-webster.com/dictionary/paddle (last visited Nov. 4, 2020).*

*Primary Examiner* — Laura Davison
(74) *Attorney, Agent, or Firm* — Schmeiser, Olsen & Watts, LLP

(57) ABSTRACT

A training system includes a launching device house a computer electrically connected to a mechanical hopper and a plunger disposed within a casing sized to launch a lacrosse ball. The casing is structured and arranged to be movably connected to the housing such that at least one of a launch angle, speed, direction, distance and spin can all be selectively chosen by a user. At least one sensor is designed to be placed onto at least one of a player, the lacrosse ball, or a lacrosse net such that the sensors are structured and arranged to relay metric data to the computer in connection with a training program software operating on the computer, wherein the sensor(s) are wirelessly connected to the computer. A mobile device software application communicates with the computer for tracking the metric data and selective programming of the lacrosse ball tossing and training system by the player.

6 Claims, 8 Drawing Sheets

(51) Int. Cl.

| | |
|---|---|
| ***A63B 69/00*** | (2006.01) |
| ***A63B 71/06*** | (2006.01) |
| ***A63B 43/00*** | (2006.01) |
| *A63B 71/02* | (2006.01) |
| *A63B 102/14* | (2015.01) |

(52) U.S. Cl.
CPC ... *A63B 2220/833* (2013.01); *A63B 2220/836* (2013.01); *A63B 2225/20* (2013.01); *A63B 2225/50* (2013.01); *A63B 2225/74* (2020.08)

(56) References Cited

U.S. PATENT DOCUMENTS

| | | | | |
|---|---|---|---|---|
| 5,816,953 | A * | 10/1998 | Cleveland | A63B 69/38 463/3 |
| 6,167,878 | B1 * | 1/2001 | Nickerson | A63B 69/409 124/64 |
| 6,539,931 | B2 * | 4/2003 | Trajkovic | A63B 24/00 124/32 |
| 8,206,246 | B2 | 6/2012 | Joseph et al. | |
| 8,419,560 | B2 * | 4/2013 | Amini | A63B 69/38 473/131 |
| 9,573,035 | B2 | 2/2017 | DeCarlo | |
| 2004/0063521 | A1 * | 4/2004 | Oister | A63B 24/0021 473/476 |
| 2013/0104870 | A1 * | 5/2013 | Rizzo | A63B 69/40 124/78 |
| 2015/0352425 | A1 * | 12/2015 | Lewis | A63B 69/40 124/78 |

* cited by examiner

BALL TOSSING AND TRAINING DEVICE AND SYSTEM

This application claims benefit to U.S. Provisional Application No. 62/308,954 filed on Mar. 16, 2016, which is hereby incorporated by reference in its entirety.

BACKGROUND OF THE INVENTION

1. The Field of the Present Invention

The present invention relates generally to a ball tossing and training device. More specifically the invention is designed to toss a lacrosse ball in a training method and system for improving fundamental lacrosse shooting skills.

2. General Background

The sport of lacrosse has seen a steady participation rate increase for the last decade. It has been the fastest growing sport on two feet. Sixty-five percent of participation has come from the youth sector (under 15). More high schools and colleges have been added and a successful professional league as well. Players are continuously trying to gain an edge as more and more are starting to learn the game at a very young age. When learning the mechanics of using a lacrosse stick one must do many repetitions. Practicing with repetition is the key to developing a lacrosse players shot. The concept of muscle memory is vital in the development of an accurate and consistent lacrosse shot.

One drill that players perform on a regular basis is a toss to shoot drill. The idea behind this drill is that one player kneels down at a distance of two to three feet away and tosses the ball up to the shooters stick. The player attempts to catch the lacrosse ball in mid-air and shoot the ball into a nearby lacrosse net. For the drill be performed correctly the player tossing the ball must be consistent and accurate with the height and time during and between each toss. If the tosses are not timed correctly, a shooter will lose his/her focus and momentum.

Some motive behind the invention can be explained in at least six points. First, the training device works in a repetitive nature so that the shooter will not break focus and momentum by having to manually pick up a ball off the ground to shoot again. Second, the training device permits the shooter to practice his/her shooting without the need of someone else. Third, the training device will be able to control both height and time between each ball release, as well as have a random mode which the height will change automatically when the next ball is released. Fourth, in a voice mode, the player will be able to release the ball from the hopper by using voice recognition. Fifth, the training device can be easily transported due to its compact structure. Also the shooter will be able to house the balls inside the device while in transit. Lastly, there is a mobile device software application interconnected with the training device to allow simple user setup, statistical data collection and analysis as well as the ability to suggest improvements in team training and player development.

SUMMARY OF THE INVENTION

A lacrosse ball tossing and training system is provided that includes a launching device that houses a computer electrically connected to a mechanical hopper and a plunger disposed within a casing sized to launch a lacrosse ball. The casing is structured and arranged to be movably connected to the housing such that at least one of a launch angle, speed, direction, distance and spin can all be selectively chosen by a user. At least one sensor is designed to be placed onto at least one of a player, the lacrosse ball, or a lacrosse net such that the sensors are structured and arranged to relay metric data to the computer in connection with a training program software operating on the computer, wherein the sensor(s) are wirelessly connected to the computer. A mobile device software application communicates with the computer for tracking the metric data and selective programming of the ball tossing and training system by the player.

In accordance with the invention, the computer may comprise a selectively programmed random mode to launch the lacrosse ball(s) in a random manner to simulate an inaccurate pass likely to occur in a real lacrosse match.

Additionally, the training system is designed to release the lacrosse ball(s) at unknown heights for as many balls that are in the hopper to increase the user's ability to adapt to changing scenarios.

A mobile device software application is adapted to detect at least one of the speed of the lacrosse ball, accuracy of location of the lacrosse ball relative to a target, and/or a number of launches of the lacrosse ball from the housing. Additionally, the mobile device application is adapted to store data, compare data, and reset data.

To enhance the training capabilities of the invention, a target may be provided having at least one sensor mounted on a target, wherein the mobile device software application is adapted to receive data from the at least one sensor attached to the target.

Moreover, the mobile device software application may comprise audio keys and voice recognition capabilities that allow the user to determine the ball trajectory, timing and height in order to simulate game environment training.

BRIEF DESCRIPTION OF THE DRAWINGS

While the specification concludes with claims particularly pointing out and distinctly claiming the present invention, it is believed the same will be better understood from the following description taken in conjunction with the accompanying drawings, which illustrate, in a non-limiting fashion, the best mode presently contemplated for carrying out the present invention, and in which like reference numerals designate like parts throughout the Figures, wherein:

DETAILED DESCRIPTION OF THE EXEMPLARY EMBODIMENTS

Figure 1:
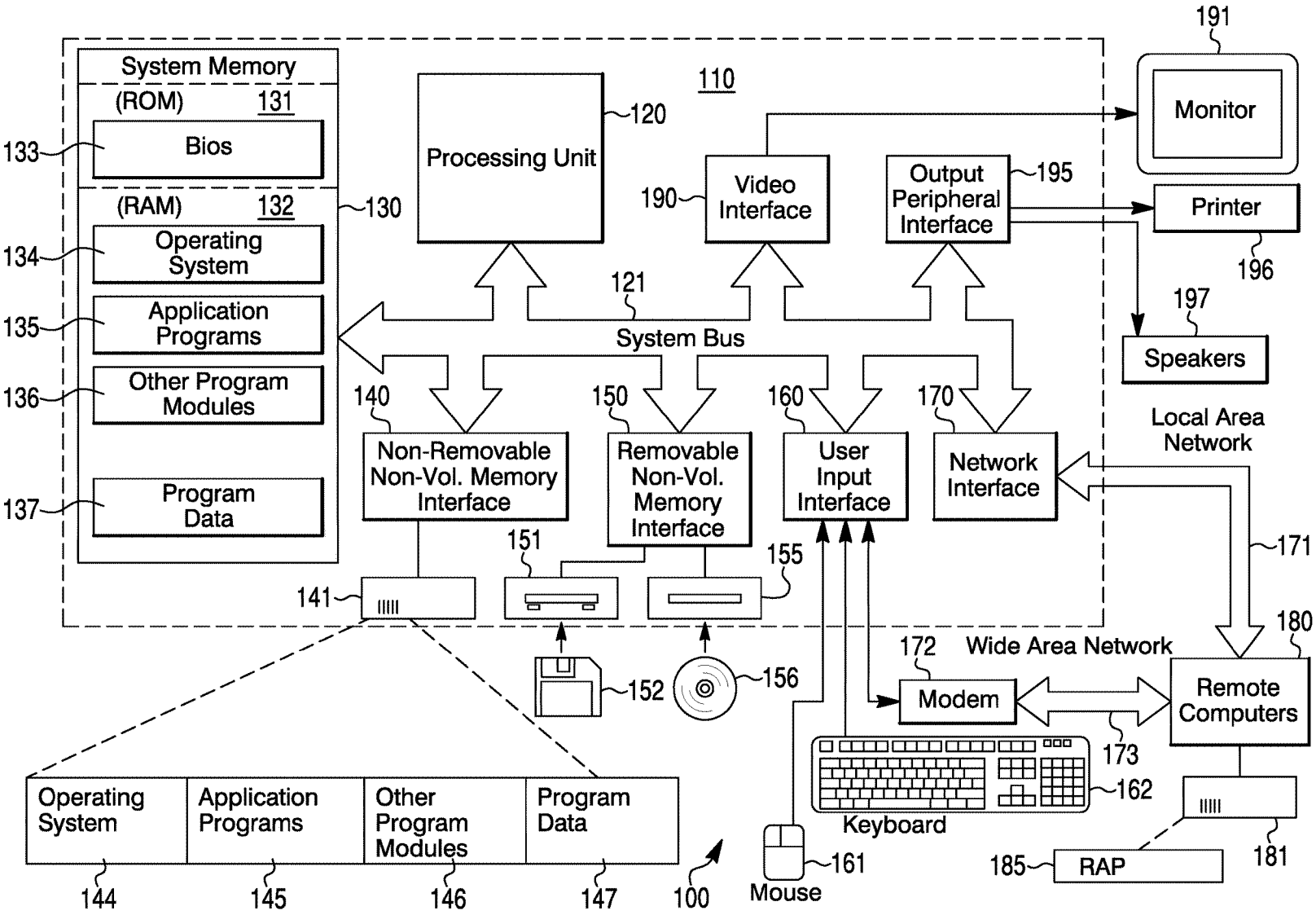
FIG. 1 is a block diagram showing an exemplary computing environment in which aspects of the present invention may be implemented.

Advantages of the present invention include an apparatus that will develop user's shot faster and more accurate. This is true because the apparatus can be set to toss lacrosse balls at selected heights and time increments. The training device can also have a selectively programmed random mode that was created to simulate an inaccurate pass. For example, the ball will release from apparatus at unknown heights for as many balls that are in the hopper. When using the training device the player will have the feel of real game shooting as opposed to the manual way of shooting practice by placing balls on the ground and having to scoop one up a time, shoot and repeat, breaking one's concentration. The training device keeps the players mind on shooting, moving feet, quickly setting feet and receiving the next ball to shoot. The training device can be used by youth players all the way up to professionals and recreational players—boy, girls, women and men.

The invention further includes a training device companion application ("app"): The app will track the speed of a shot as well as track accuracy, shot counter and a shot chart. The app will be able to store data, compare data, and reset the data. The app will work with shot sensors attached to a user's lacrosse net or cage. Statistics will then be transferred for the user to view in the app. This app will be compatible for Apple IOS and Android.

The training device may have a visual colored light when the last lacrosse ball is released from hopper telling the user that this is the last lacrosse ball. The training device may also employ audio keys as well as voice recognition allowing the user to call the ball trajectory, timing and height similar to game environment training.

Some training drills usable with the present invention may include:

Speed and height drill—the player may set a preferred height and set at comfortable time interval that the ball will be released. The player may take appropriate shots until the hopper is empty. The player may repeat training exercise and decrease the time intervals that the lacrosse ball will be released from the device which in turn will make the shooter shoot faster. The player can also set for different heights to shoot all overhand shots, refill hopper and heights for all sidearm shots and do the same for underhand shots.

Quick hands drill—a player may set the machine closer to the lacrosse net and set a preferred release interval and catch and shoot quick stick shots. The player may add some flare and throw a fake in the mix and then shoot and try to receive next ball. This drill will improve speed of catch and release.

Lax and Conditioning Drill—place a cone 5-10 yards away from machine. A player may catch a lacrosse ball, perform the player's favorite dodge and run to a cone or shoot into net. A player may run back to the machine to receive the next ball before it touches the ground, and repeat the exercise until the hopper is empty, which is a great exercise to get in game playing shape.

Random Mode Shooting Drill—a lacrosse ball will release from the machine at random heights and times. A "high" toss can be received for an overhand shot, a "mid" toss can be received for a sidearm shot, and a "low" toss can be received for an underhand shot.

Core Blaster—a player may receive balls from the machine in a seated or kneeling position. This drill will enhance a player's core. Also, this drill is useful if player cannot stand due to injury, but can still practice shooting.

A player may receive balls while sitting on a bench or chair from the machine and shoot in a seated position, which is a useful drill if the player has an injury and cannot stand and shoot.

In a first embodiment, the present invention includes a ball tossing and training system having a housing having a computer connected to a mechanical hopper and a plunger disposed within a casing sized to launch a lacrosse ball, the casing structured and arranged to be movably connected to the housing such that a launch angle, speed, direction, distance and spin can all be selectively chosen by a user, where the computer is wirelessly connected to at least one sensor designed to be placed onto at least one of the player, the ball, or a lacrosse net such that the sensors are structured and arranged to relay metric data to the computer in connection with a training program software operating on the computer; and the computer is further connected to a mobile device software application for tracking the metric data and selective programming of the ball tossing and training system by the player.

The present disclosure will now be described more fully with reference to the Figures in which an embodiment of the present disclosure is shown. The subject matter of this disclosure may, however, be embodied in many different forms and should not be construed as being limited to the embodiments set forth herein.

FIG. 1 illustrates an example of a suitable computing system environment 100 on which aspects of the subject matter described herein may be implemented. The computing system environment 100 is only one example of a suitable computing environment and is not intended to suggest any limitation as to the scope of use or functionality of aspects of the subject matter described herein. Neither should the computing environment 100 be interpreted as having any dependency or requirement relating to any one or combination of components illustrated in the exemplary operating environment 100. The computing system environment 100 will be capable of computing data delivered to and received from the training system described below with respect to FIGS. 2-6.

Aspects of the subject matter described herein are operational with numerous other general purpose or special purpose computing system environments or configurations. Examples of well-known computing systems, environments, and/or configurations that may be suitable for use with aspects of the subject matter described herein include, but are not limited to, personal computers, server computers, hand-held or laptop devices, multiprocessor systems, microcontroller-based systems, settop boxes, programmable consumer electronics, network PCs, minicomputers, mainframe computers, distributed computing environments that include any of the above systems or devices, and the like.

Aspects of the subject matter described herein may be described in the general context of computer-executable instructions, such as program modules, being executed by a computer. Generally, program modules include routines, programs, objects, components, data structures, and so forth, which perform particular tasks or implement particular abstract data types. Aspects of the subject matter described herein may also be practiced in distributed computing environments where tasks are performed by remote processing devices that are linked through a communications network. In a distributed computing environment, program modules may be located in both local and remote computer storage media including memory storage devices.

With reference to FIG. 1, an exemplary system for implementing aspects of the subject matter described herein includes a general-purpose computing device in the form of a computer 110. Components of the computer 110 may include, but are not limited to, a processing unit 120, a system memory 130, and a system bus 121 that couples various system components including the system memory to the processing unit 120. The system bus 121 may be any of several types of bus structures including a memory bus or memory controller, a peripheral bus, and a local bus using any of a variety of bus architectures. By way of example, and not limitation, such architectures include Industry Standard Architecture (ISA) bus, Micro Channel Architecture (MCA) bus, Enhanced ISA (EISA) bus, Video Electronics Standards Association (VESA) local bus, and Peripheral Component Interconnect (PCI) bus also known as Mezzanine bus.

Computer 110 typically includes a variety of computer-readable media. Computer-readable media can be any available media that can be accessed by the computer 110 and includes both volatile and nonvolatile media, and removable and non-removable media. By way of example, and not limitation, computer-readable media may comprise computer storage media and communication media. Computer storage media includes both volatile and nonvolatile, removable and non-removable media implemented in any method or technology for storage of information such as computer-readable instructions, data structures, program modules, or other data. Computer storage media includes, but is not limited to, RAM, ROM, EEPROM, flash memory or other memory technology, CD-ROM, digital versatile discs (DVDs) or other optical disk storage, magnetic cassettes, magnetic tape, magnetic disk storage or other magnetic storage devices, or any other medium which can be used to store the desired information and which can be accessed by the computer 110. Communication media typically embodies computer-readable instructions, data structures, program modules, or other data in a modulated data signal such as a carrier wave or other transport mechanism and includes any information delivery media. The term "modulated data signal" means a signal that has one or more of its characteristics set or changed in such a manner as to encode information in the signal. By way of example, and not limitation, communication media includes wired media such as a wired network or direct-wired connection, and wireless media such as acoustic, RF, infrared and other wireless media. Combinations of any of the above should also be included within the scope of computer-readable media.

The system memory 130 includes computer storage media in the form of volatile and/or nonvolatile memory such as read only memory (ROM) 131 and random access memory (RAM) 132. A basic input/output system 133 (BIOS), containing the basic routines that help to transfer information between elements within computer 110, such as during start-up, is typically stored in ROM 131. RAM 132 typically contains data and/or program modules that are immediately accessible to and/or presently being operated on by processing unit 120. By way of example, and not limitation, FIG. 1 illustrates operating system 134, application programs 135, other program modules 136, and program data 137.

The computer 110 may also include other removable/non-removable, volatile and nonvolatile computer storage media. By way of example only, FIG. 1 illustrates a hard disk drive 141 that reads from or writes to non-removable, nonvolatile magnetic media, a magnetic disk drive 151 that reads from or writes to a removable, nonvolatile magnetic disk 152, and an optical disc drive 155 that reads from or writes to a removable, nonvolatile optical disc 156 such as a CD ROM or other optical media. Other removable/non-removable, volatile/nonvolatile computer storage media that can be used in the exemplary operating environment include, but are not limited to, magnetic tape cassettes, flash memory cards, digital versatile discs, digital video tape, solid state RAM, solid state ROM, and the like. The hard disk drive 141 is typically connected to the system bus 121 through a non-removable memory interface such as interface 140, and magnetic disk drive 151 and optical disc drive 155 are typically connected to the system bus 121 by a removable memory interface, such as interface 150.

The drives and their associated computer storage media, discussed above and illustrated in FIG. 1, provide storage of computer-readable instructions, data structures, program modules, and other data for the computer 110. In FIG. 1, for example, hard disk drive 141 is illustrated as storing operating system 144, application programs 145, other program modules 146, and program data 147. Note that these components can either be the same as or different from operating system 134, application programs 135, other program modules 136, and program data 137.

Operating system 144, application programs 145, other program modules 146, and program data 147 are given different numbers herein to illustrate that, at a minimum, they are different copies. A user may enter commands and information into the computer 20 through input devices such as a keyboard 162 and pointing device 161, commonly referred to as a mouse, trackball or touch pad. Other input devices (not shown) may include a microphone, joystick, game pad, satellite dish, scanner, a touch-sensitive screen of a handheld PC or other writing tablet, or the like. These and other input devices are often connected to the processing unit 120 through a user input interface 160 that is coupled to the system bus, but may be connected by other interface and bus structures, such as a parallel port, game port or a universal serial bus (USB). A monitor 191 or other type of display device is also connected to the system bus 121 via an interface, such as a video interface 190. In addition to the monitor, computers may also include other peripheral output devices such as speakers 197 and printer 196, which may be connected through an output peripheral interface 195.

The computer 110 may operate in a networked environment using logical connections to one or more remote computers, such as a remote computer 180. The remote computer 180 may be a personal computer, a server, a router, a network PC, a peer device or other common network node, and typically includes many or all of the elements described above relative to the computer 110, although only a memory storage device 181 has been illustrated in FIG. 1. The logical connections depicted in FIG. 1 include a local area network (LAN) 171 and a wide area network (WAN) 173, but may also include other networks. Such networking environments are commonplace in offices, enterprise-wide computer networks, intranets and the Internet.

When used in a LAN networking environment, the computer 110 is connected to the LAN 171 through a network interface or adapter 170. When used in a WAN networking environment, the computer 110 typically includes a modem 172 or other means for establishing communications over the WAN 173, such as the Internet. The modem 172, which may be internal or external, may be connected to the system bus 121 via the user input interface 160 or other appropriate mechanism. In a networked environment, program modules depicted relative to the computer 110, or portions thereof, may be stored in the remote memory storage device. By way of example, and not limitation, FIG. 1 illustrates remote application programs 185 as residing on memory device 181. It will be appreciated that the network connections shown are exemplary and other means of establishing a communications link between the computers may be used.

Figure 2:
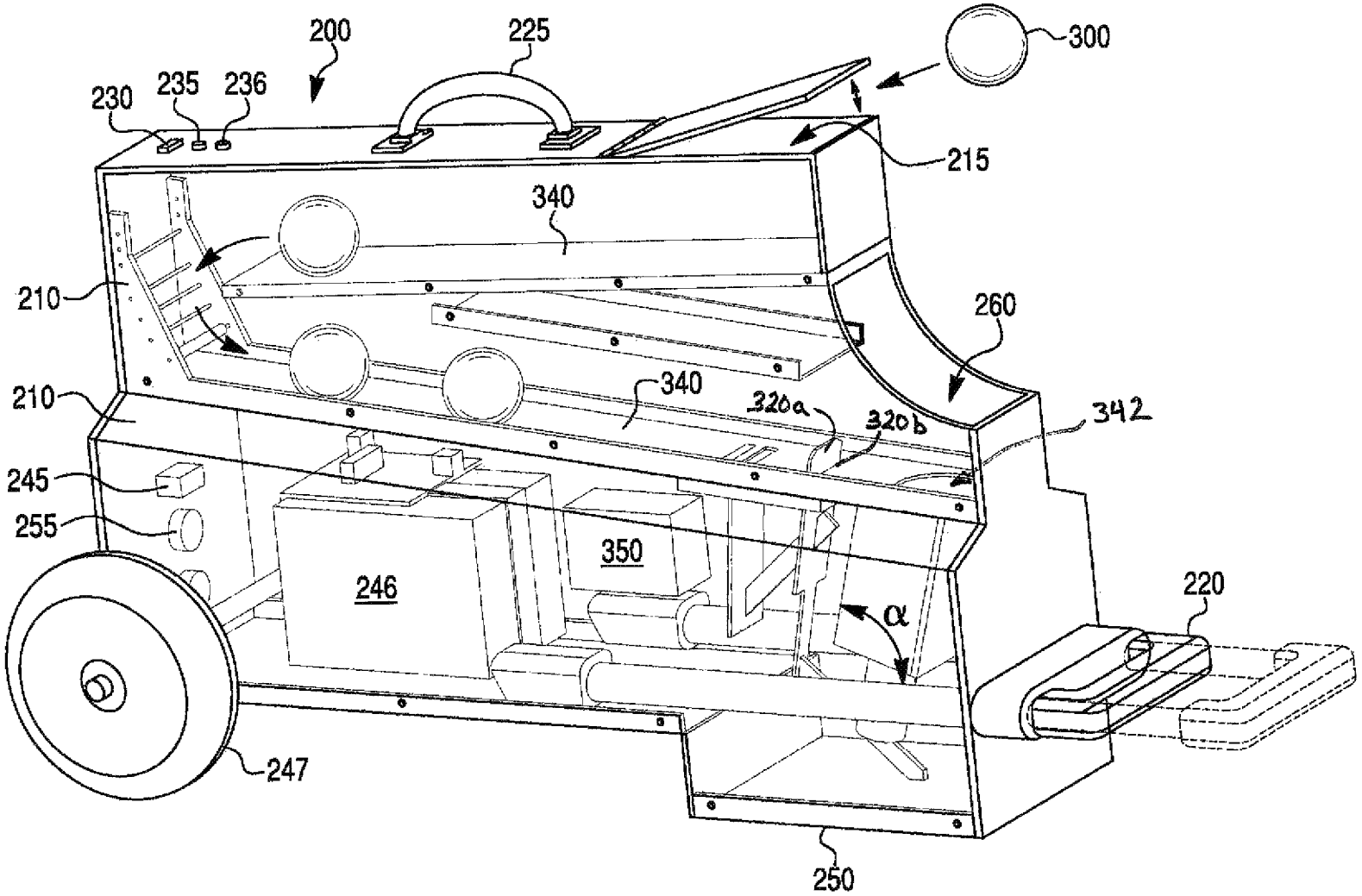
FIG. 2 shows a perspective front view of the ball tossing and training device and system according to one embodiment of the present invention.

Referring now to FIG. 2 there is shown a perspective front view of the ball tossing and training device and system 200 according to one embodiment of the present invention. Device 200 includes housing 210 having a telescoping handle 220, a stationary handle 225, ball entry port 215, power switch 230, with lights 235 and 236. In addition there is ball release port 260, battery charger light 255, battery charger port 245 along with wheels and legs 247 and 250. A battery 246 and computer 350 are generically shown in FIG. 2. A plunger and casing as shown in FIG. 1 relative to discharge or release port 260; however, it is further envisioned that the plunger system may be pivoted (see arrow a) to various positions to provide a wide range of trajectory angles including a horizontal position in order to project the lacrosse balls along the ground.

Figure 3:
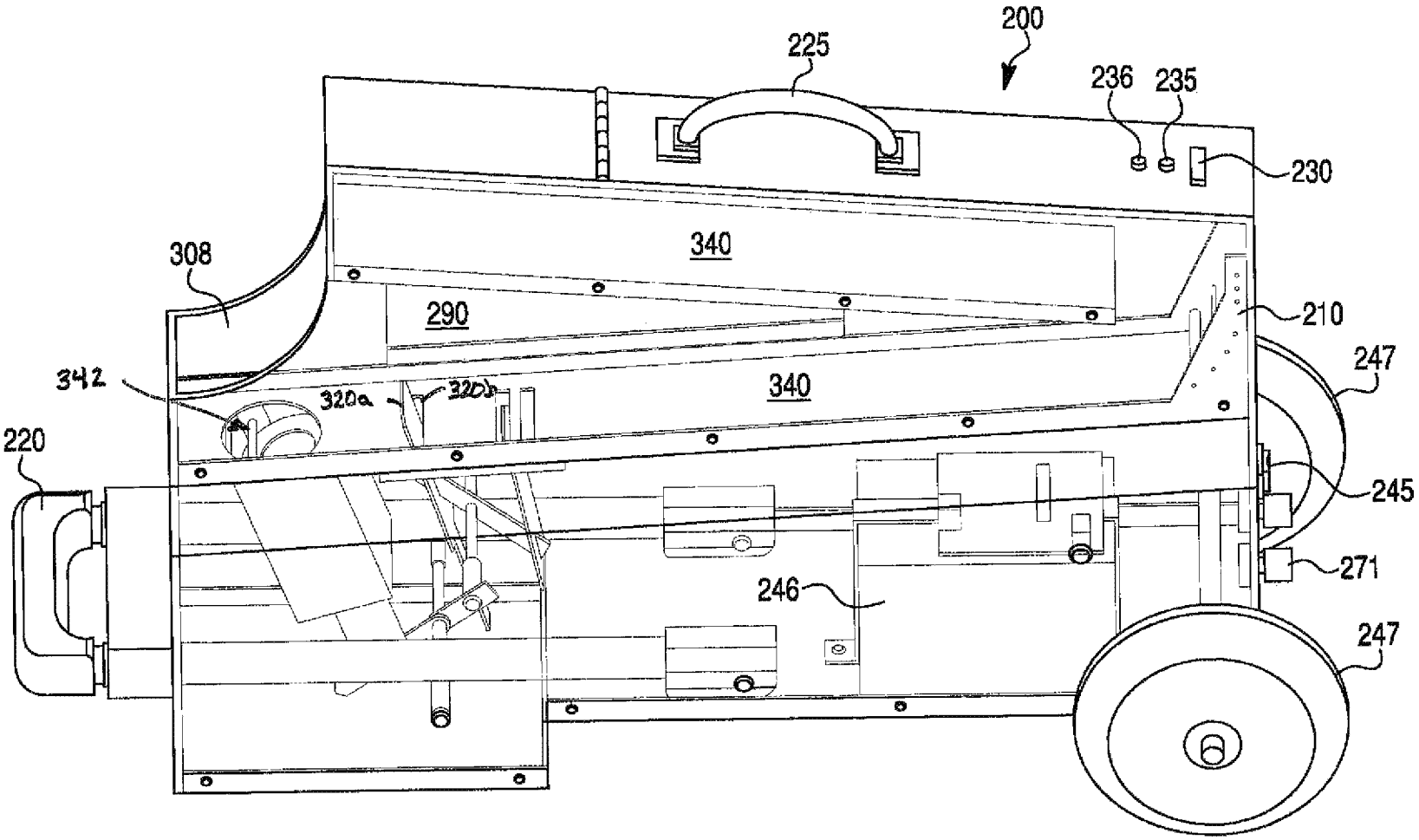
FIG. 3 shows a rear view of the ball tossing and training device and system according to one embodiment of the present invention.

Referring now to FIG. 3 there is shown a top perspective view of the ball tossing and training device and system 200 according to one embodiment of the present invention. There may also be a storage space which may include multiple ports 271 such as such as a USB, IEEE1394 or wired IEEE 802.3 Ethernet port, or other electrical and/or computer physical or wireless connection. A series of serpentine tracks 340 for delivering the lacrosse balls 300 to the release area terminating at a lacrosse ball seating aperature is also illustrated in FIGS. 2 and 3.

Figure 4:
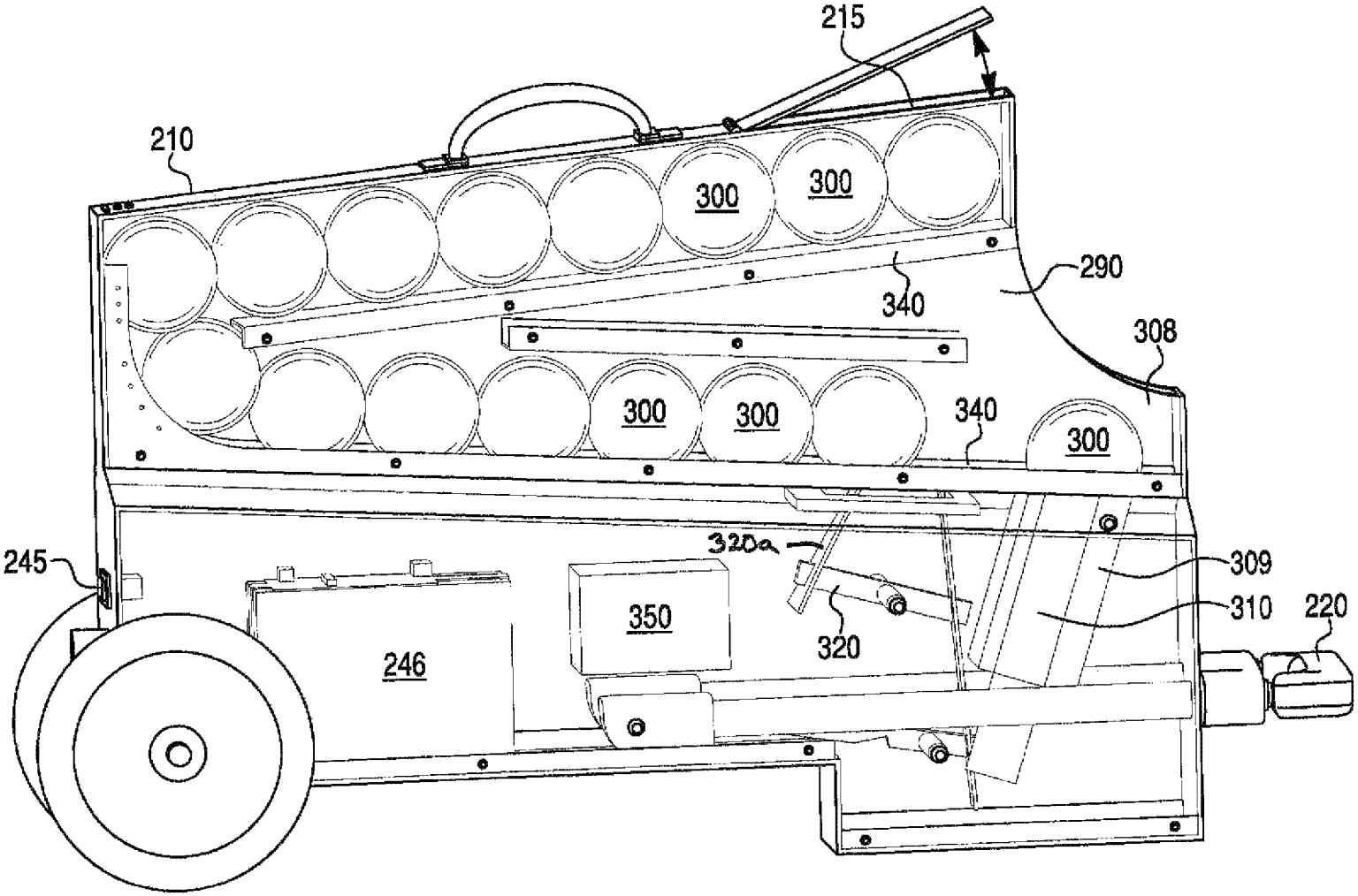
FIG. 4 shows a side view of the ball tossing and training device and system according to one embodiment of the present invention.

Referring now to FIG. 4 there is shown a side view of the ball tossing and training device and system 200 according to one embodiment of the present invention. Housing 210 includes battery port 245 for battery 246. The housing 210 encloses hopper 290 which received balls 300 from port 215 and distributes balls 300 to eject area 308 which includes plunger casing 309 that ejects the lacrosse balls 300 according to signals received from computer 350 which it is interconnected thereto. Computer 350 can include elements according to FIG. 1 in a manner known to those of skill in the art. Plunger 310 is also interconnected to computer 350 and discharges balls 300 according to pre-determined programming as desired by the user. The plunger 310 is structured and arranged to selectively discharge ball(s) 300 to a desired height and distance from the device 200. Casing 309 is movably affixed to housing 210 and includes mechanical fittings so that casing 309 is structured and arranged to change discharge timing, launch angle, height, distance and ball spin according to a user's desired training program. In some embodiment the device 200 may launch balls 300 on the ground. After a single ball 300 is discharged from the housing via plunger 310, the ball release mechanism 320 releases another ball 300 which rolls down the track 340 and into position at the lacrosse ball seating aperture (see lacrosse ball 300 seated in aperture in FIG. 4) to be discharged in succession, slow, rapid, intermediate, or random, as determined by the user through the ball release port 260. The ball release mechanism 320 includes a paddle 320*a* which passes through a slot 320*b* in the track 340. See FIGS. 2, 3 and 4. The paddle 320*a* selectively blocks and releases balls 300 on track 340 toward the ball seating aperture 342.

Figure 5:
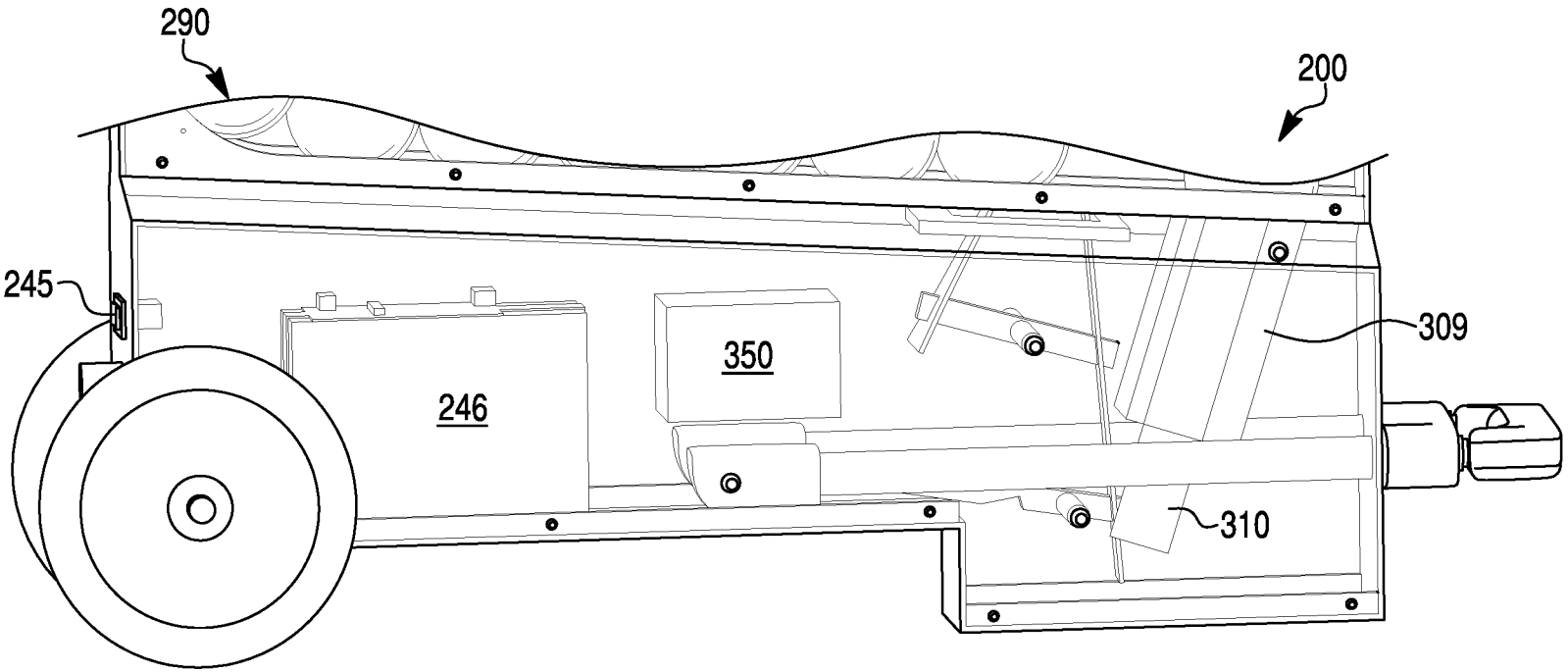
FIG. 5 shows an exposed view of the internal elements and features of the ball tossing and training device and system according to one embodiment of the present invention.

FIG. 5 shows an exposed partial view of the internal elements and features of the ball tossing and training device and system 210 according to one embodiment of the present invention. Housing 210 encloses a hopper 290 which receives balls 300 from port 215 and distributes balls 300 toward plunger casing 309 according to signals received from computer 350 which it is interconnected thereto. In one embodiment, a battery 246 powers the entire system. Computer 350 can include elements according to FIG. 1 or other electronics known to those of skill in the art. A plunger 310 is also interconnected to computer 350 and discharges balls 300 according to pre-determined programming as desired by the user. The plunger 310 is structured and arranged to selectively discharge ball 300 to a desired height and distance from the device 200.

Figure 6:
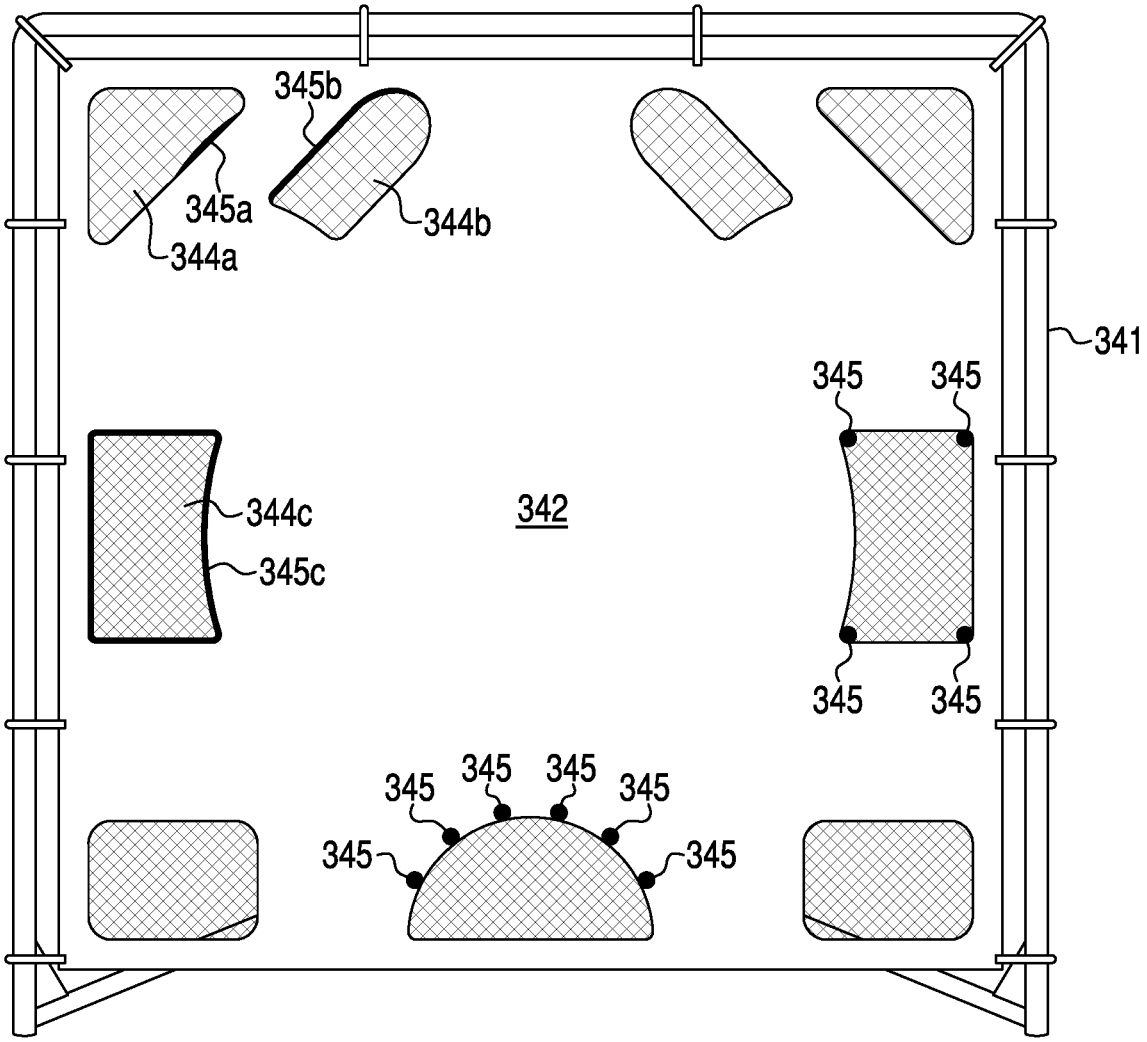
FIG. 6 shows a wireless sensors placed onto a lacrosse cage in connection with the ball tossing and training device and system according to one embodiment of the present invention.

Referring now to FIG. 6 there is shown series of wireless sensors 345, a, b, c, . . . n which can be placed upon different selective locations including a lacrosse goal, a player, a player's stick and in some cases on or within ball 300. In FIG. 6, the sensors 345*a*, 345*b*, 345*c*, etc. are disposed at target areas 344*a*, 344*b*, 344*c*, . . . 344*n* on the goal target 342. The goal target 342 is designed with select target areas 344 selectively having sensors 345 disposed thereon for detecting and analyzing ball movement, location and speed relative to the lacrosse cage 341 and the target areas 344. The sensors can be placed onto a lacrosse cage 341 to determine ball shot trajectories, including location, speed, and angle. Optionally, the sensors can be placed onto the player the player's body, lacrosse stick or lacrosse ball 300 in order to provide data on each of these in connection with the training program desired by the user. The sensors can be wirelessly connected to the device 200 via RFID, Bluetooth® or WiFi or other similar wireless connection technology.

In accordance with this invention, the launch device 210 may be connected to a mobile software application to provide real time and statistical training metrics for the player.

Figure 7:
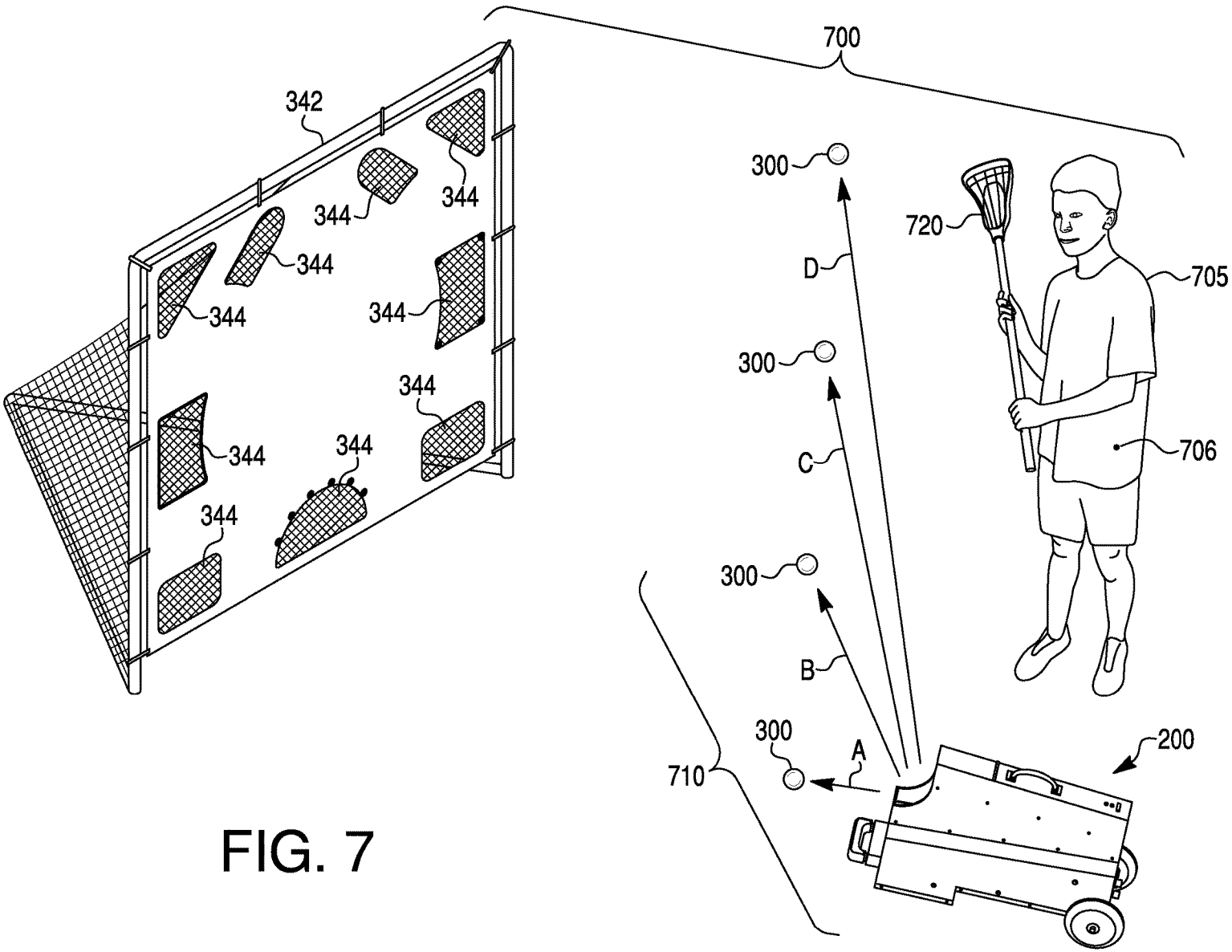
FIG. 7 illustrates a lacrosse player in relation to the target goal and the launcher in accordance with an embodiment of the present invention.

Referring now to FIG. 7, a system 700 for improving a lacrosse player's efficiency in shooting a lacrosse ball 300 toward a goal 342 is shown. The system 700 comprises a lacrosse launcher or ejector 200 (for example, as described with respect to FIGS. 2-5) that is capable of receiving a plurality of lacrosse balls 300 and ejecting them toward a plurality of different areas, locations or positions A, B, C, D relative to a lacrosse player 705 and/or lacrosse playing area 710. For ease of illustration, the plurality of different positions A, B, C, D correspond to position near the player 705 in a simulated lacrosse field. It will be appreciated that the launcher or ejector 200 may be programmed to fire lacrosse balls to different heights and different positions depending on the training exercise.

The launcher or ejector 20 is a described above with respect to FIGS. 2-5.

It is noted that the launcher 200 may also comprises a ball retrieval system relative to the goal or net system which facilitates gathering lacrosse balls 300 that are thrown toward the goal 342, for example, the lacrosse balls 200 may collect in the net area behind the goal 342 and be conveyed back to the hopper section of the launcher 200.

As described with respect to FIG. 6, a plurality of sensors 345 is coupled to the net disposed on the goal 342 and electronically coupled to the controller or computer 350. The photo sensors 345 sense when the player 705 has successfully shot the lacrosse ball 300 through the target areas 344 provided on the target 342.

FIG. 7 illustrates a lacrosse player 705 in relation to the target goal 342 and the launcher 200. In the illustration being described, the controller or computer 350 comprises a plurality of routines or algorithms for improving the player's shooting efficiency. The routines may include a launch challenge routine for challenging the player in shooting a lacrosse ball 300 towards the at least one or a plurality of different areas 344 of the target 342. The shooter challenge routine facilitates improving a player's efficiency in that they provide a player 705 with feedback as to his or her shooting accuracy. With the feedback, the player 705 can focus his or her shooting practice on those areas where the player's efficiency is below a predetermined or preselected efficiency percentage. In the illustration being described, the predetermined efficiency may be any desired or selected shooting efficiency, such as 30% or 40%. For example, if a player's shooting efficiency falls below the predetermined threshold, such as 40% in the illustration being described, the player 705 may alter his or her practice routine to focus on the areas where the player 705 needs to improve his or her shooting efficiency.

Referring back to FIG. 1, the controller or operating system 134 further comprises means or apparatus for calculating the shooting efficiency using a shooting efficiency calculator. The shooting efficiency calculator calculates a shooting efficiency of the player 705 at the at least one or a plurality of the plurality of different positions where the player 705 shot the lacrosse 300. The player's position may be determined by a sensor 706 mounted to the player 705 (see FIG. 7). The shooting efficiency calculator may provide shooting efficiency statistics and data during one or more of the shooter challenge routines mentioned later herein, but it is also capable of providing historical or cumulative data regarding a player's lifetime or career shooting statistics at each of the plurality of different locations. Again, the player 705 or a coach (not shown) may use the information, statistics or data as feedback in order to improve the player's efficiency in shooting the lacrosse ball 300 at the one or more of the plurality of different target areas 344.

Referring back to FIG. 1, the system 110 comprises a user interface and a display or monitor 191. The system 110 further comprises a system memory 130, such as an electronic storage device or other electronic storage, for storing data relative to the player's efficiency, such as data regarding the player's performance during one or more of the shooter challenge routines and even historical or cumulative information regarding a player's performance over a predetermined period or even a player's career in shooting using the system 110.

As mentioned earlier, a predetermined or desired efficiency threshold, such as 40% in the illustration being described, may be selected. The player 705 can use the information and identify those spots where the player's shooting efficiency dropped below the predetermined or desired efficiency threshold. Using this information, the player or the coach (not shown) may then program the system 110 using the various system interfaces to direct one or more respected shots to those particular spots where the player's efficiency dropped below the predetermined threshold. For example, the player or coach may employ voice recognition to direct the launch system 200 to launch the lacrosse ball(s) 300 in a specific direction or at a specific height. In a manner conventionally known, the player may select a number of shots to shoot at the one or more of predetermined plurality of different locations or alternatively, the player may select initially or after reviewing his or her efficiency percentages to shoot a number of shots at each of the plurality of different locations where the player's performance efficiency was deficient using one or more of the shooter challenge routines.

In the illustration being described, the shooter challenge routines are programs stored in a read only memory 131 and under control of the system 110.

The player or a coach may select a challenge shooting accuracy button program whereupon the system 110 will begin the shooter challenge routines. A multiple shots in a row routine requires the player 705 to make the number of shots consecutively before the launcher 200 is caused to throw lacrosse balls 300 at the next programmed spot. A total number of shots routine requires the player to make the total number of shots before the launcher 200 begins throwing lacrosse balls 300 at the next programmed spot. During this routine, the player 705 does not have to make the number of shots consecutively. In this regard, if the player selects the challenge shooting accuracy program either manually or using voice recognition, the system 110 prompts the user to determine whether the player desires to make multiple shots in a row or multiple shots at each spot before the launcher 200 is caused to pivot and throw lacrosse balls 300 to the next height or location, without the requirement that the shots be made in a row.

The photo sensor(s) 345 senses when a lacrosse ball 300 passes through the target(s) 344 (FIG. 6) and therefore when a shot by a player has been made. The photo sensor(s) 345 determine whether the shot was made by the player and if it was not then the program may loop back to reset the routine. If the shot was made, the system 110 increments the count by one and it is determined whether or not the total number, which is the number that the player has programmed or commanded. If the system 110 determines that the total number of shots made, as represented by the COUNT variable, is equal to the predetermined number of shots to be made as selected by the player 705, then the routine continues. In accordance with the invention, sensors may be mounted to the lacrosse balls 300 to sense speed, direction, spin, and location of the lacrosse balls 300 being used by the training system of this invention. All of this data may be utilized by the system 110 to assess a player's skills and training efficiency.

In general, the system 110 comprises the user interface 40, e.g., manual, voice, remote control, wireless, etc., that enables the user to select the shooting practice that the user desires. During the first step, the user turns the power to the launcher 200 and the system 110 on and selects either the preprogrammed drills or the user can select at least one or a plurality of different locations at which the player 705 will shoot the lacrosse ball(s) 300. The system 110 receives the selected positions information and stores it in memory (not shown). The user may select a time delay between passes using various system interfaces as described.

Advantageously, this system 110 and method provide means for improving the player's efficiency at shooting the lacrosse ball 300 at one or more of the plurality of different locations 344. The system and method enables a player to select number of shots and number of positions at which the player will shoot at least one lacrosse ball. The system and method further permits repeating the catching, throwing, and shooting steps until the player has performed a number of shots toward each of number of positions. The repetition and accurate location sensing will enhance the player's skill level for catching, throwing and shooting toward a specific number of targets.

Figure 8:
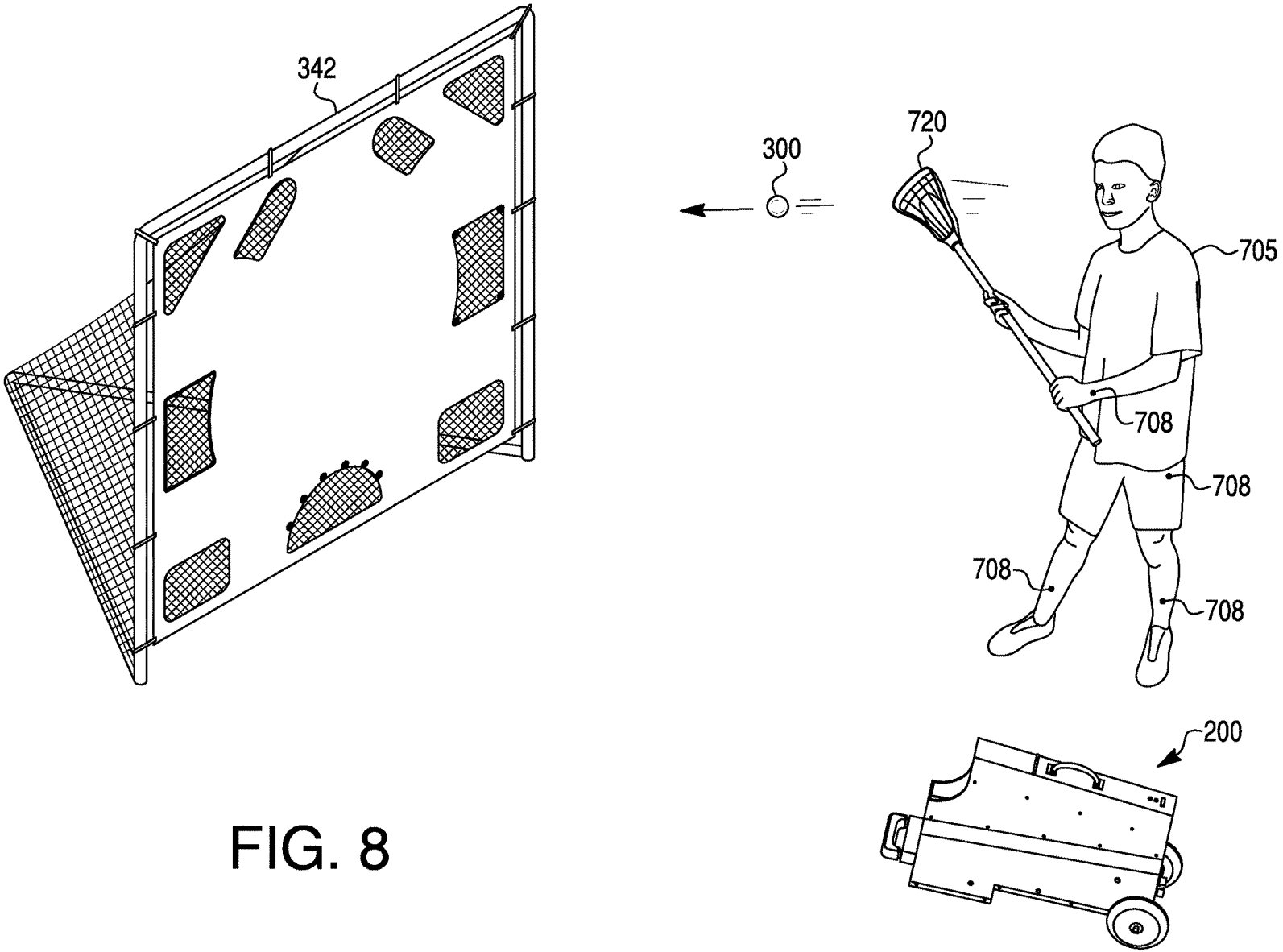
FIG. 8 illustrates a player as shown shooting a lacrosse ball toward a target area in accordance with an embodiment of the present invention.

FIG. 8 illustrates a player as shown shooting a lacrosse ball toward a target area in accordance with an embodiment of the present invention. In accordance with this invention, the system may comprises additional sensors mounted to the lacrosse stick 720 (FIG. 7) and sensors 708 may be mounted to the arms and legs of the player 705 to measure and analyze player's stance and motion during the practice routine. More specifically, the system may monitor the player's foot position, hip position, arm position, etc. using sensors disposed on the player's uniform. In this way, the system 110 may measure and assess the player's technique during the catching and shooting process as lacrosse balls are tossed to the player 705 and the player shoots the lacrosse balls toward the target areas 344.

It will be apparent to one of skill in the art that described herein is a novel ball tossing and training device and system. While the invention has been described with reference to specific preferred embodiments, it is not limited to these embodiments. The invention may be modified or varied in many ways and such modifications and variations as would be obvious to one of skill in the art are within the scope and spirit of the invention and are included within the scope of the following claims.

The invention claimed is:

1. A lacrosse ball tossing and training system comprising:

a housing having a computer electrically connected to a mechanical hopper, a track leading to a lacrosse ball seating aperture, a ball release mechanism including a paddle passing through an opening in said track to selectively release lacrosse balls to roll down said track, and an elongated ejecting plunger disposed within a casing sized to contact and launch a first lacrosse ball in a vertical direction through a ball release port formed as part of the housing, said housing being elongated along a longitudinal axis, wherein said track is a serpentine track extending in at least two different linear but angled opposing directions along said longitudinal axis within said housing, said track terminating adjacent said lacrosse ball seating aperture, at least one wheel rotatively disposed at a first end of said housing, a first handle disposed at a second end of said housing opposite said first end, said first handle disposed to telescope into and out of said housing, a second handle disposed at a top surface of said housing, said ball release port opening in an upward, angled direction with respect to said longitudinal axis and pointing away from said longitudinal axis, said ball release port being above said first handle and below said second handle, said lacrosse ball seating aperture adjacent said elongated ejecting plunger to position said first lacrosse ball in a stationary position relative to and in line with said elongated ejecting plunger while being contacted by said plunger, said plunger being selectively actuated by signals received from said computer to contact said first lacrosse ball prior to receiving a second ball delivered from said track delivering a series of lacrosse balls to said lacrosse ball seating aperture, wherein the casing is structured and arranged to be movably connected to and within the housing, while said lacrosse ball seating aperture remains in a fixed position relative to said housing and said ball release port formed as part of said housing, said housing encapsulating said mechanical hopper, said computer, said track, said ball release mechanism and said casing while providing said ball release port and as an exit opening in said housing for said lacrosse balls when said plunger is actuated to launch said first lacrosse ball;

at least one sensor designed to be placed onto at least one of said user, the first lacrosse ball, or a lacrosse net such that the sensors are structured and arranged to relay metric data to the computer in connection with a training program software operating on the computer, said at least one sensor being wirelessly connected to said computer; and wherein said computer is adapted to communicate with a mobile device software application in communication with said computer for permitting control of an operation of said ball tossing and training system by the user.

2. The system of claim 1, further comprising sensors disposed on a target to detect at least one of speed of said first lacrosse ball, and accuracy of location of said lacrosse ball relative to said target.

3. The system of claim 1, wherein said mobile device software application is adapted to receive data from sensors mounted to multiple body parts of the player to assess and record physical motion of the player during a training exercise.

4. The system of claim 1, further comprising, a target spaced from said housing, said at least one sensor being mounted on said target, wherein said mobile device software application is adapted to receive data from said at least one sensor attached to said target.

5. The system of claim 1, wherein said at least one sensor is configured to be affixed to the user, wherein data is transmitted to said mobile device software application from said at least one sensor affixed to said user to determine a position of at least one body part of said user during a practice session.

6. The system of claim 1, wherein said at least one sensor is mounted to said first lacrosse ball, wherein data is transmitted to said mobile device software application related to a speed and direction of said first lacrosse ball.

* * * * *